US007270190B2

(12) United States Patent
McWhorter et al.

(10) Patent No.: US 7,270,190 B2
(45) Date of Patent: Sep. 18, 2007

(54) VARIABLE SIZE COIL TUBING GRIPPING ELEMENTS

(75) Inventors: David McWhorter, Magnolia, TX (US); Donald Jones, Conroe, TX (US)

(73) Assignee: Varco I/P, Houston, TX (US)

( * ) Notice: Subject to any disclaimer, the term of this patent is extended or adjusted under 35 U.S.C. 154(b) by 137 days.

(21) Appl. No.: 10/908,410

(22) Filed: May 11, 2005

(65) Prior Publication Data

US 2006/0254780 A1 Nov. 16, 2006

Related U.S. Application Data

(63) Continuation of application No. PCT/US2004/032792, filed on Oct. 5, 2004.

(60) Provisional application No. 60/509,795, filed on Oct. 9, 2003.

(51) Int. Cl.
*E21B 19/00* (2006.01)

(52) U.S. Cl. ..... 166/382; 166/86.3

(58) Field of Classification Search ..... 166/86.3, 166/85.4, 382, 77.51, 77.1, 77.2; 251/1.1, 251/1.2, 1.3
See application file for complete search history.

(56) References Cited

U.S. PATENT DOCUMENTS

| | | | | |
|---|---|---|---|---|
| 3,897,038 | A | 7/1975 | LeRouax | 251/1 |
| 3,915,426 | A | 10/1975 | LeRouax | |
| 4,229,012 | A | 10/1980 | Williams, III | 277/325 |
| 5,005,802 | A | 4/1991 | McWhorter et al. | 251/1.3 |
| 5,009,289 | A | 4/1991 | Nance | |
| 5,251,870 | A | 10/1993 | Ward | |
| 5,309,990 | A * | 5/1994 | Lance | 166/77.3 |
| 5,575,451 | A * | 11/1996 | Colvin et al. | 251/1.3 |
| 6,089,526 | A | 7/2000 | Olson | 251/1.3 |
| 6,367,804 | B1 | 4/2002 | Watts | 277/325 |
| 6,543,546 | B2 * | 4/2003 | Kaiser | 166/382 |

* cited by examiner

*Primary Examiner*—David Bagnell
*Assistant Examiner*—David Andrews
(74) *Attorney, Agent, or Firm*—Law Office of Tim Cook P.C.

(57) ABSTRACT

A variable ram for coiled tubing comprises a pair of opposing rams, each ram having a ram body with a vertical channel formed therein; a pair of opposing pins within each ram head, the pins extending into the channel; and a toothed gripper having a hole therein sized to mount over its respective pin.

6 Claims, 2 Drawing Sheets

VARIABLE SIZE COIL TUBING GRIPPING ELEMENTS

This application is a continuation of PCT Application Ser. No. PCT/US04/032792 filed Oct. 5, 2004 which claims the benefit of U.S. Provisional Patent Application Ser. No. 60/509,795 filed Oct. 9, 2003

FIELD OF THE INVENTION

The present invention relates generally to the field of blowout preventers for tubing, and, more particularly, to a slip ram in a blowout preventer adapted to accommodate tubing which tapers or otherwise varies in its outside diameter.

BACKGROUND OF THE INVENTION

The use of blowout preventers in drilling, completion, workover, and production of oil and gas wells is well known. Such blowout preventers generally include a housing with a bore extending through the housing. Opposed chambers extend laterally on either side of the bore in the housing and communicate with the bore. Rams within the chambers are connected to rods that are supported for moving the rams inwardly into the bore to close off the bore. This action divides the bore into a zone above the rams and a zone below the rams. The rods also serve to retract outwardly from the bore to open the bore.

Various types of rams may be employed such as those which engage circumferentially around a pipe or tubular member for sealing engagement with the tube or pipe, while others are provided with cutting surfaces for shearing tubular members or cables which extend through the bore of the blowout preventer.

Blowout preventers (BOPs) are also commonly used in coiled tubing systems. Such BOPs provide a means of holding the tubing and isolating the well bore pressure during a variety of conditions, including emergencies. The configuration of the BOP rams and sideport facility allows well-control operations to be conducted under a variety of conditions.

Newer blowout preventers include four sets of rams, which may be referred to herein as a "Quad BOP". The system comprises a set of four stacked elements, each with a different function. Blind rams are shut when there is no tubing or tool string extending through the body of the BOP. Shear rams are designed to close on and cut through the tubing. Slip rams close on and hold the tubing, ideally without damaging the surface of the piping or other tubular member. Finally, pipe rams seal around the tubing when it is in place. Each of the rams should only be actuated when the tubing is stationary; otherwise, damage to either the BOP or the tubing is likely. Of the four types of rams just described, the present invention is directed to the slip ram type for use with tubing.

As previously explained, a slip ram closes onto a tubular, and in the case of the present invention, closes on and holds tubing. Slip segments to grip and suspend coiled tubing are well known and widely used in coiled tubing applications. The slips are typically installed in a set of rams. The slips are most often made in two pieces, one piece in each ram, with gripper teeth on the semi circle resulting in near 360 degrees coverage of the coiled tubing diameter. The gripper section is machined to a specific inside diameter to match the outside diameter of the coiled tubing. This system works reasonably well as long as the coiled tubing is of a constant diameter. Over-worked coiled tubing may become undersized, oversized, or out of round, all of which reduce, or negate the effectiveness of the slip segment gripper teeth.

Furthermore, recent innovations have provided tubing which has a substantially constant inside diameter, but a substantially constantly increasing outside diameter, so that the tubing presents a tapered aspect in its outside diameter. Development of such a tapered outside diameter coiled tubing renders the gripping system with a set diameter unworkable. In other words, with a first length of tubing through the slip ram, a relatively small diameter of tubing must be accommodated by the slip ram. However, with a longer length of tubing down hole, a larger diameter of tubing must be grasped and held. Current structures of slip rams offer a set diameter of the ram, provided in equal halves on either side of the tubular, and this is incapable of accommodating the varying diameter of tubing which is presented to the slip ram, if the outside diameter of the tubing varies with length. It is believed that the prior art has failed to solve, or even address this problem.

In summary, as coiled tubing technology has advanced, the need to go deeper has also advanced. Inherent problems with increased depth are many, included among these is increased tubing string weight. One method of reducing string weight is to use different sizes of coiled tubing joined together. Therefore the need arises to be able to perform all of the conventional pressure control methods, one of which, and the subject of this invention, is to grip and hold the variable size tubing, including the transition zone. The present invention addresses this need in the art.

SUMMARY OF THE INVENTION

The present invention provides a gripping element that is arranged in opposing pairs and is held within the confines of a conventional coil tubing ram to grip and hold variable sized coil tubing. Typically, the transition zone between smaller (lower) and the larger (upper) tubing elements is on the order of eight feet which creates a taper over this distance. The design of the gripping elements allows a contact patch of sufficient size to be employed over any portion of the variable sized coiled tubing string. The elements which make up each pair are pinned relatively loosely to a ram body so that the pair acting in concert can accommodate a range of outside diameters of the tubing through the ram.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
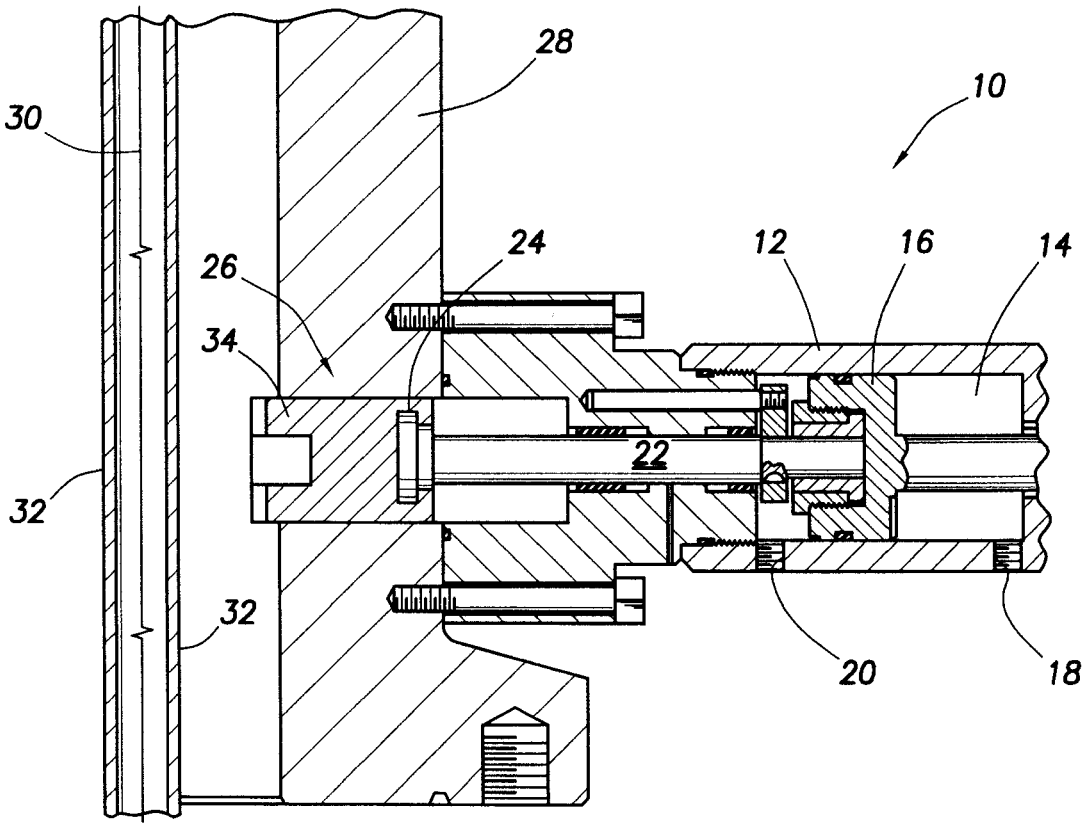
FIG. 1 is an elevation section view of an actuator and coiled tubing slip ram constructed in accordance with the teachings of the present invention.

FIG. 1 illustrates the slip of the present invention in its intended environment. An actuator 10 includes a cylinder body 12 enclosing a cylinder chamber 14 having a piston 16 therein. A close port 18 directs hydraulic fluid pressure to one side of the piston to close the ram, and an open port 20 directs hydraulic fluid pressure to the other side of the piston to open the ram. The piston 16 connects to a rod 22 which terminates at a flange 24 which connects to a slip 26 of this invention, shown and described below in greater detail.

The slip 26 moves within a body 28 of a blowout preventer which is aligned along a center axis 30. It is to be understood that a similar slip (not shown in FIG. 1) is positioned opposite the slip 26 to enclose a coiled tubing 32 passing through the blowout preventer. Upon actuation, the slip 26 closes in around the coiled tubing 32 in a manner to be described below.

Figure 2:
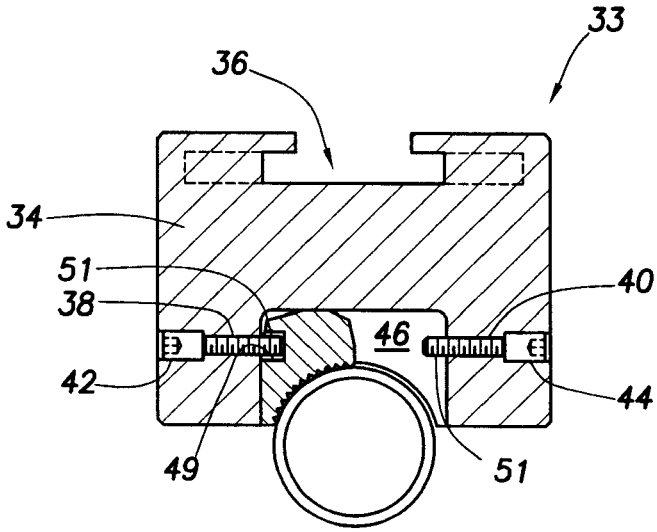
FIG. 2 is a top section view of a slip ram with one gripper element shown.

FIG. 2 illustrates a variable gripper element 33 of this invention. The gripper element comprises a ram body 34 which includes an opening 36 to receive the flange 24 at the end of the rod 22, as shown in FIG. 1. The ram body 34 has a first hole 38 and a second hole 40 formed therein. The first hole 38 receives a first pin 42 and the second hole receives a second pin 44. The pins 42 and 44 extend into a vertical channel 46.

A toothed gripper 48 is loosely mounted onto the pin 42 and positioned within the channel 46. A complementary toothed gripper 48 is mounted on the pin 44 and abutting contact between the grippers keeps them within the channel. The gripper 48 defines a well 49 which is large in relation to a head 51 on the pin 42 so that the gripper is free to conform to a range of sizes of tubing.

Figure 3:
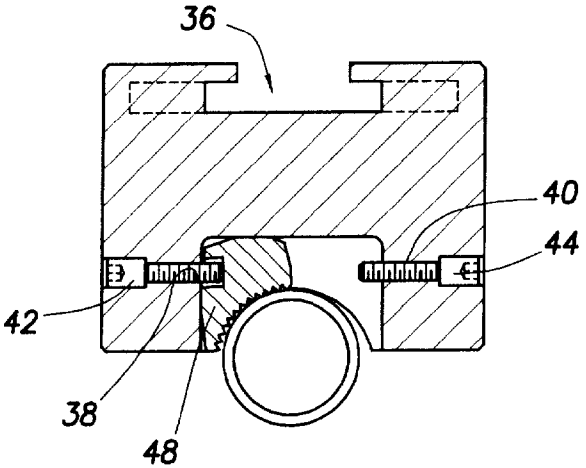
FIG. 3 is a top section view of the slip ram of FIG. 1, with the gripper around a smaller section of coiled tubing.

Since the gripper is loosely mounted, a smaller coiled tubing, such as that shown in FIG. 3, causes the toothed gripper to rotate back into the channel 46, effectively closing around the coiled tubing. In this way, the slip of the present invention is capable of accommodating the outside diameter of coiled tubing at either end of a transition zone. This is because the each of the grippers rotates about a vertical axis defined by its respective pin head.

Figure 4:
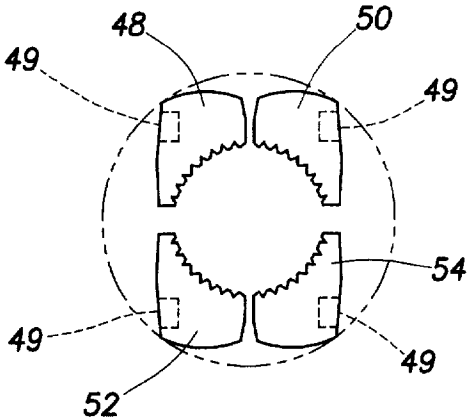
FIG. 4 is a top view of four gripper elements of this invention.

FIG. 4 shows a set of four toothed grippers, numbered 48, 50, 52, and 54. Grippers 48 and 50 act together, and grippers 52 and 54 act together to collapse in around a coiled tubing. Each of the gripper has a well 49 (See FIG. 2) formed therein to receive its respective pin.

Figure 6:
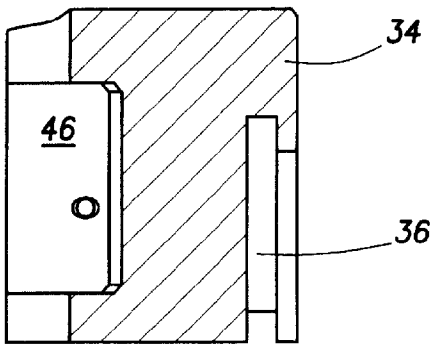
FIG. 6 is an elevation view of a ram from the side.
Figure 5:
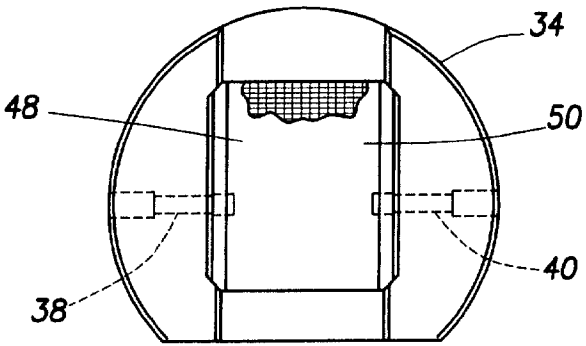
FIG. 5 is an elevation view of a ram showing the mounting of gripper elements.

Finally, note now particularly FIGS. 5 and 6. FIG. 5 provides a face-on view of a ram body 34 with the grippers 48 and 50 closed in abutting engagement just enough to enclose a tubing inserted between them. Sufficient play is provided by mounting the grippers loosely on pins 38 and 40, all within the channel 46, as shown in FIG. 6.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

What is claimed is:

1. A variable ram for coiled tubing comprising:

a. a pair of opposing rams, each ram having a ram body with a vertical channel formed therein;

b. a first pair of opposing, horizontally extending pins within a first ram body, the first pair of opposing pins extending into the channel of the first ram body;

c. a second pair of opposing, horizontally extending pins within a second ram body, the second pair of opposing pins extending into the channel of the second ram body;

d. a first toothed gripper having a well therein sized to mount over one of the first pair of pins and a second toothed gripper having a well therein sized to mount over the other of the first pair of pins, wherein the first and second grippers are retained on their respective pins by abutting engagement between the first and second grippers; and e. a third toothed gripper having a well therein sized to mount over one of the second pair of pins and a fourth toothed gripper having a well therein sized to mount of the other of the second pair of pins.

2. The ram of claim 1, wherein the first and second grippers are loosely mounted on their respective pins.

3. The ram of claim 1, wherein the first and second grippers are adapted to accommodate the outside diameter of coiled tubing at either end of a transition zone.

4. The ram of claim 1, wherein the first and second grippers each rotate about a respective vertical axis centered on an end of its respective pin.

5. A method of gripping a tube through a blowout preventer, comprising the steps of:

a. loosely mounting a pair of opposing gripper elements within a ram body supporting a pair of opposing, horizontally extending pins, each of the pair of opposing pins defining a pin head, each gripper mounted on one of the pin heads;

b. inserting a tubular through the blowout preventer; and c. pressing the loosely mounted pair of opposing gripper elements against the tubular so that the gripper elements grip around the tubular.

6. A variable, gripping slip ram for coiled tubing comprising:

a. a pair of opposing rams, each ram having a ram body with a respective vertical channel formed therein; and b. at least two grippers loosely held within the respective vertical channel of each ram body and adapted to grip a range of sizes of tubes within the ram, each of the grippers non-attachedly mounted to a respective, horizontally extending pin.

* * * * *